US006311340B1

(12) United States Patent
Thompson

(10) Patent No.: US 6,311,340 B1
(45) Date of Patent: Nov. 6, 2001

(54) DISPENSING DEVICE

(75) Inventor: Guy R. Thompson, Inverness, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/554,303

(22) PCT Filed: Nov. 10, 1998

(86) PCT No.: PCT/US98/23972

§ 371 Date: May 11, 2000

§ 102(e) Date: May 11, 2000

(87) PCT Pub. No.: WO99/24679

PCT Pub. Date: May 20, 1999

(30) Foreign Application Priority Data

Nov. 11, 1997 (GB) ..... 9723785

(51) Int. Cl.[7] ..... E03D 9/02
(52) U.S. Cl. ..... 4/231
(58) Field of Search ..... 4/227.1, 231

(56) References Cited

U.S. PATENT DOCUMENTS 4,048,050 9/1977 Hillman ..... 206/1.5
5,346,069 9/1994 Intini ..... 206/531

FOREIGN PATENT DOCUMENTS

465975 * 1/1992 (EP) ..... 4/231
517562 * 12/1992 (EP) ..... 4/231
0 586 137 9/1994 (EP) .

* cited by examiner

*Primary Examiner*—Robert M. Fetsuga

(57) ABSTRACT

A toilet bowl rim mounted dispenser for receiving a block of product to be dispensed into the toilet is disclosed. The dispenser includes first and second body parts rotatable about a hinge, and a hook for suspending the dispenser from the rim. The body parts include at least one releasable catch which is engaged on rotation of the body parts from an open to a closed position. One body part is provided with a locking means which is biased towards a first position in which it acts on the catch to resist release of the catch but is movable by applied manual force to a second position in which the catch can be released. The locking means has block engaging means which engage with a toilet block when the block is present in the dispenser to prevent release of the locking member while the dispenser contains a new toilet block.

18 Claims, 5 Drawing Sheets

DISPENSING DEVICE

TECHNICAL FIELD

The present invention relates to a device for dispensing a product into the bowl of a water closet (toilet). In particular, it relates to a device adapted to be hooked under the rim of a toilet bowl to interrupt the flow of water as the toilet is flushed, and to dispense the product directly into the toilet bowl.

The product placed in such a dispenser is in the form of a block of solid material, and is sometimes known as a rim block, and the dispenser is sometimes described as a rim block cage.

BACKGROUND ART

In the past, rim blocks usually consisted only of fragrancing materials.

Refillable rim block dispensers were known but there was not a great need to provide them with child resistant closures. More recently, rim blocks containing bleaching agents have been put on the market, and the desirability of ensuring that any refillable dispensers are child resistant has increased. A number of refillable dispensers have been placed on the market in some countries. Thus one company markets a bleaching rim block in a dispenser with a catch released by pressing the end of the suspension hook into the cage. Other refillable dispensers on the market are not reliably child resistant.

Toilet blocks are relatively low cost products. They are used in dispensers which are attached to the rim of toilet bowls. The dispensers for reasons of cost are produced as a single plastics moulding which includes a hook and two body parts joined by a moulded hinge. Once the toilet block has been placed in the dispenser by the manufacturer, no one will wish to obtain access to the toilet block within the cage. Any need to open the dispenser will only arise in the case of refillable dispensers, when a replacement block will be inserted when the original block has been used.

Child-resistant packages based on containers with a hinged cover are known for other products such as medicines. In such containers, the user requires to obtain access to the container at relatively frequent intervals in order to remove the medicine within the container. Hinged containers for medicines in which catches on one part of the container engage with apertures on another part of the container are disclosed, for example, in U.S. Pat. No. 5,346,069. This discloses the use of two types of catch. Both types must be opened before the container itself can be opened. However, the catches are designed to be opened sequentially. The ability to open each set of catches in sequence simplifies the opening procedure, which is desirable for a container which is intended to opened frequently. Attempts to operate all the catches simultaneously are stated to be counter-productive. The parts which have to be manually operated are all catches, i.e., they are constituted by parts which interact to hold the container in the closed position.

U.S. Pat. No. 4,048,050 discloses a hinged child resistant pill box which has a pair of catches which hold the container closed. The box also has means which must be actuated before the catches can be released. However, the means consists of pivot pins running in slots. The catches are essentially bayonet-type catches. Rearward movement of the cover is normally prevented by the interaction of members 35 and 34.

When the body is flexed to release these catches to allow rearward movement, the member 35 is moved clear of slot 32 so allowing the cover to be pivoted. This system requires a complex hinge structure. Closing the container requires a first (rotary) movement to bring the top and bottom parts of the container together and a second (translational) movement to cause catches to engage to hold the container in a closed position. Such a complex closing operation does not appear to be suitable for use in producing relatively low cost products which are generally produced on automated filling lines. The container does not seem suitable for manufacture as a one piece moulding.

It has now been found that an improved child resistant dispenser for attachment of toilet bowls can be produced by a combination of a releasable catch to hold the dispenser closed and a locking means which must be actuated to allow the releasable catch to be released.

DISCLOSURE OF INVENTION

According to the present invention, a dispenser suitable for attachment to the rim of a toilet bowl comprises a body adapted to receive a block of product to be dispensed into the toilet bowl and a hook attached to the body for suspending the body from the rim of a toilet bowl, said body comprising first and second body parts relatively rotatable about a hinge and at least one releasable catch which is engaged on rotation of the body parts from an open to a closed position for holding the said body parts in a closed position, said hook being attached to said first body part wherein at least one releasable catch is provided with locking means, which locking means is biased towards a first position in which it acts on the releasable catch to resist release of the catch but is movable by applied manual force to a second position in which the releasable catch can be released.

It is possible to provide a locking means which, when moved to a position in which the releasable catch is released, can be held in that position, against the biasing force tending to return it to the first position, until the catch is released. However, small children find the problem of operating two mechanisms separately easier to solve than the problem of operating two mechanisms simultaneously. For this reason it is preferable to provide a dispenser in which the catch and the locking means must be operated simultaneously to release the catch.

A catch for use in the present invention will generally comprise an engaging member which projects from one body part and is sufficiently resilient to ride over a retaining member associated with the other body part as the body is caused to close, the retaining member retaining the engaging member and so holding the body closed until the catch is released.

Catches used in child resistant containers may be classified as direct or indirect catches. Direct catches are catches which are opened by manipulating the engaging member directly. Indirect catches are catches which are opened by manipulating the body rather than the engaging means itself.

It is preferred to use catches which are released by compressive forces applied towards the interior of the body, rather than tensile forces applied in directions away from the interior of the body. In other words, it is preferred to open the body by pressing rather than pulling.

It is preferred to use direct catches rather than indirect catches.

The releasable catch may be in the form of an engaging means in the form of a lug projecting forwardly from the edge of one body part towards the other body part (when the body is closed) and which carries an outwardly projecting part (outwardly in relation to the surface of the adjacent body part) which engages with a retaining member in the other body part. The retaining member may be an aperture extending through the body part or a recess within the body part.

In the case of an indirect catch, if the body is made of material which is resiliently deformable under pressure, the body part carrying the lugs can be deformed by pressing on it adjacent to the lugs so as to deform it sufficiently to move the lugs inwardly (towards the interior of the body) to disengage the projecting portions on the lugs from the locking members in the other body part. By making the projecting portions sufficiently small and the lugs sufficiently stiff, the catches can be made resistant to opening by direct pressure on the catches, even if the catches are accessible through apertures in the body.

Alternatively, the indirect catches may have forwardly projecting lugs which lie outside the other body part, and inwardly directed projections which engage locking members, e.g. apertures, in the other body part. Such catches will be released by pressure on the body part which carries the locking member, rather than the part which carries the lugs.

The two body parts may be hinged together so that the hinge is at one side of the body (the side carrying the hook being considered as the top). Preferably the hinge is on the lower side of the body opposite the hook, so that the second body part is opened by rotating it downwards.

The hinge may be constituted by coaxial rod portions on one body part which engage with coaxial apertures in the other body part. In this case, it may be possible to produce the two body parts as separate mouldings which are linked together before being filled with the material to be dispensed. However, it is preferred to make the dispenser as a one-piece moulding and for the hinge to be what is known as a "living hinge" formed by a line of reduced thickness in the moulding.

As discussed above, indirect catches are catches which are opened by exerting pressure on the body rather than on the catches themselves. The catch may be in the form of a lug projecting forwardly from the edge of one body part towards the other body part (when the body is closed) and which carries an outwardly projecting part (outwardly in relation to the surface of the adjacent body part) which engages with a retaining member on the inner surface of the other body part. The retaining member allows the projecting part to ride over it when the body is closed but retains the projecting part so as to hold the body closed. The retaining member may be a recess which does not extend through the body to the outer surface or may be an aperture in the body part. If the body is made of material which is resiliently deformable under pressure, the body part carrying the lugs can be deformed by pressing on it adjacent to the lugs so as to deform it sufficiently to move the lugs inwardly (towards the interior of the body) to disengage the projecting portions on the lugs from the locking members in the other body part. Where the projecting portions engage with apertures in the other body part, the projecting portions can be made sufficiently small and the lugs sufficiently stiff such that the catches are resistant to opening by direct pressure on the catches.

Alternatively, the indirect catches may have forwardly projecting lugs which lie outside the other body part and inwardly directed projections which engage recesses or apertures in the other body part. Such catches will be released by pressure on the body part which carries the apertures rather than the part which carries the lugs.

It may be desirable to provide a depression in the outer surface of the body part carrying a projecting portion, said depression being adjacent to the catch so as to facilitate the application of finger pressure on the body part to open the catch.

Preferably, the releasable catch is in the form of a lug carrying projections mounted on the first body part (which carries the hook) which interact with apertures in the second body part.

The catches are preferably provided with means, such as barbs, which facilitate closing the catches when the body parts are brought together, but which resist release unless pressure is applied to the barb or the body to release the catches.

Preferably the dispenser is provided with only one catch. This simplifies the manufacture of the filled dispenser. When the two body parts are hinged towards one another after a toilet block has been inserted into the open dispenser, there is only one catch to be engaged. This reduces the risk of producing incorrectly closed dispensers using automated filling equipment.

The locking means is biased towards a first position in which it resists relative movement of the body parts to release the catch. Thus a force must be applied to the locking means to release the locking means and to hold it released simultaneously with the application of force to release the catch. The locking means may be biased towards the first position as a result of the inherent resilience of the material forming the body. Preferably, as indicated above, the releasable catch and the locking means are in a form such as to allow the dispenser to be produced as a one-part moulding. The locking means is preferably moved between the first and second positions by rotation relative to the body part carrying the locking member. The force applied to the locking means to move it to the second position preferably acts towards the interior of the body.

The locking means is preferably provided with a block engagement means which engages with a toilet block within the dispenser to prevent release of the locking means while the dispenser contains a new toilet block.

A particularly preferred from of the invention comprises a dispenser suitable for attachment to the rim of a toilet bowl, comprising a body adapted to receive a block of product to be dispensed into the toilet bowl and a hook attached to the body for suspending the body from the rim of a toilet bowl, which dispenser is a one piece moulding formed of resilient thermoplastics polymer and having a direct catch comprising a lug mounted on the first body part, said catch carrying a barb which, in the closed position of the body, extends outwardly through an aperture in the second body part, and a locking means, the locking means being hinged to the second body part such that it is biased by the resilience of the polymer moulding to a first (normal) position, the locking means having a first portion and a second portion on either side of the hinge, such that in the first position the first portion engages the lug of the catch so as to prevent actuation of the catch but can be rotated about the hinge by pressure on the locking means below the hinge so as to rotate the upper portion of the locking means out of engagement with the lug, and wherein the lower portion of the locking member engages with a toilet block within the body so as to prevent rotation of the locking member when a new toilet block is present in the body.

BRIEF DESCRIPTION OF DRAWINGS

The invention will now be described with reference to the accompanying drawings in which.

BEST MODE OF CARRYING OUT THE INVENTION

Figure 1:
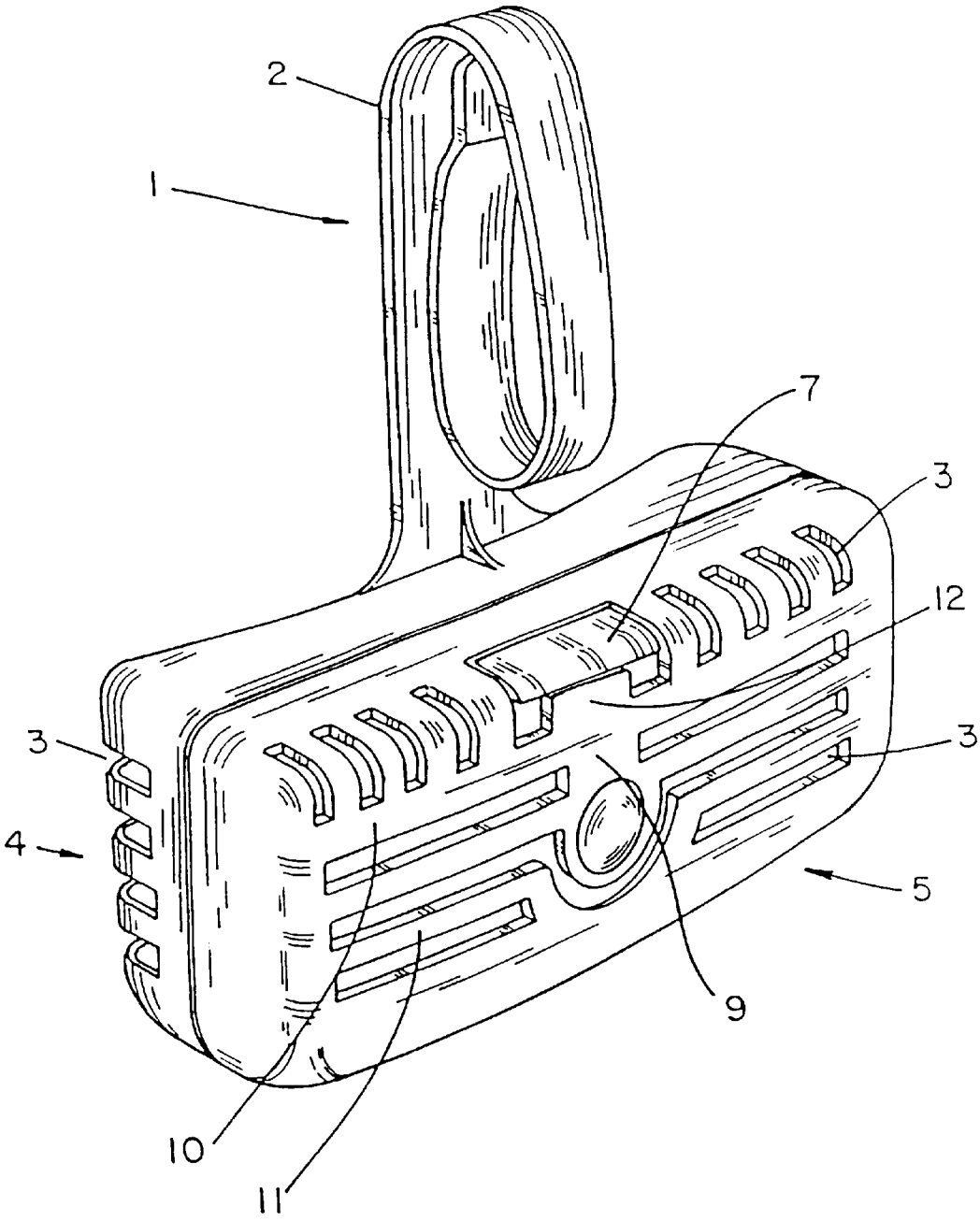
FIG. 1 is a perspective view of a dispenser according to the invention in the closed position.
Figure 2:
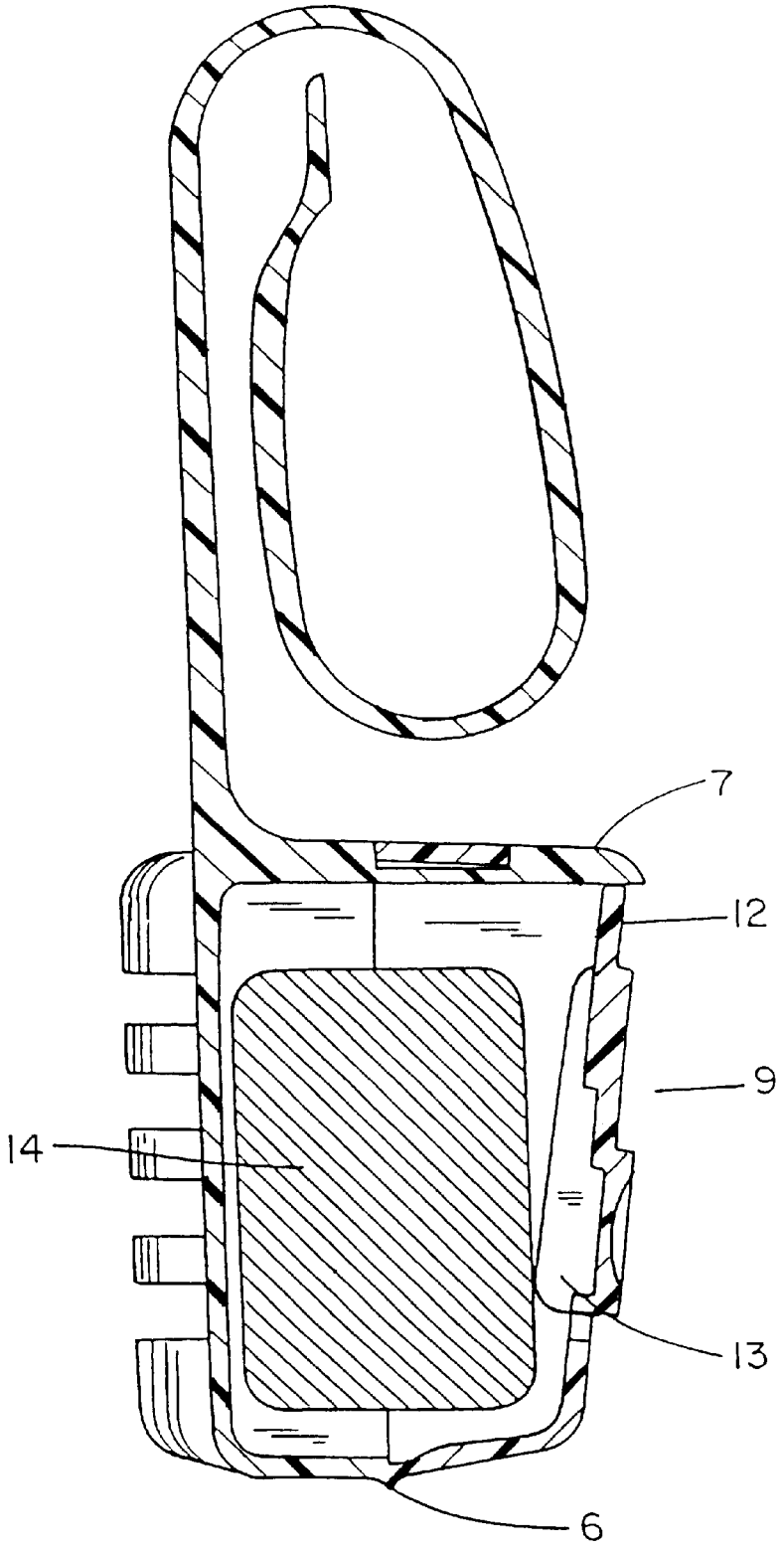
FIG. 2 is a cross-section through the dispenser of FIG. 1 showing a new toilet block in position in the dispenser.
Figure 3:
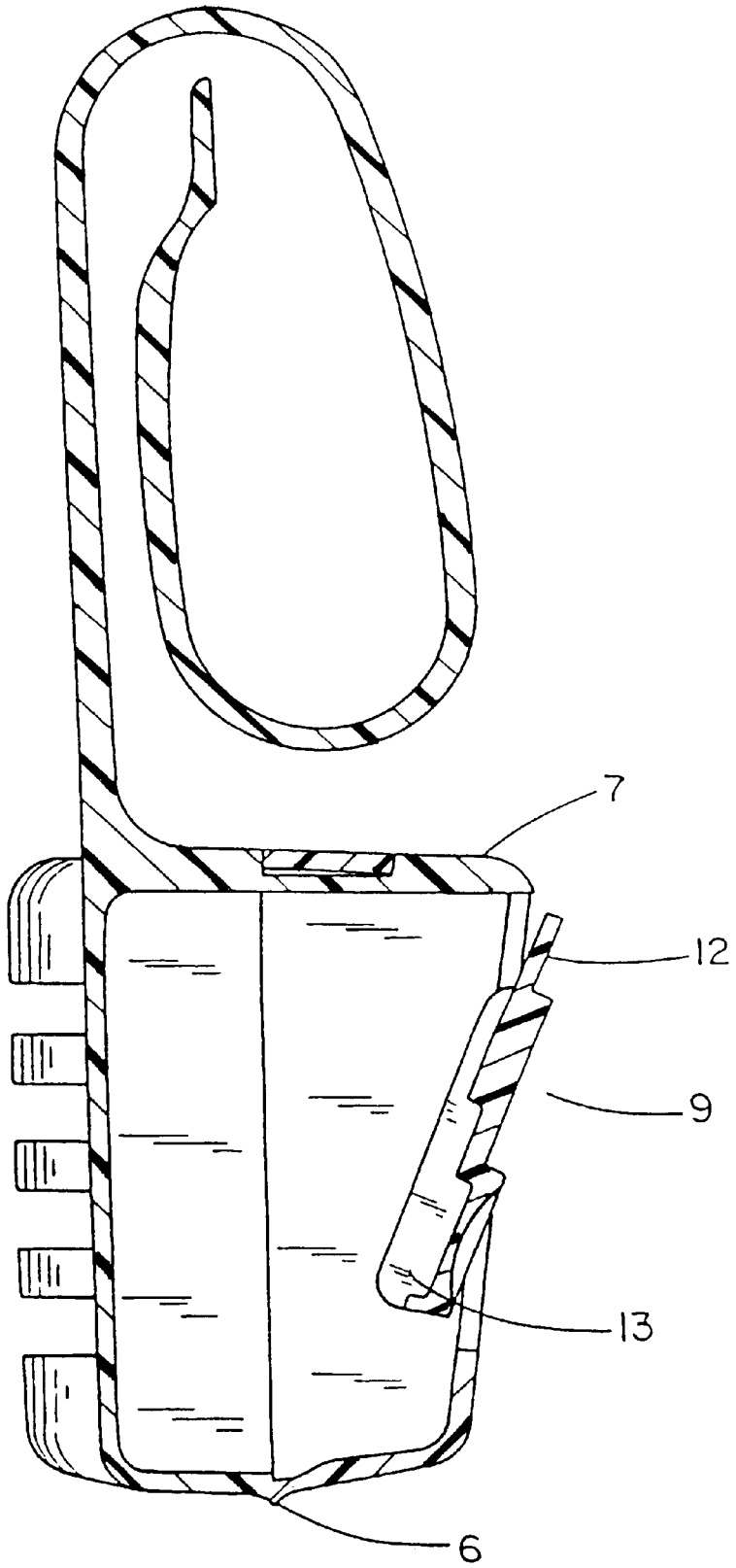
FIG. 3 is a cross section of the dispenser of FIG. 1 without a toilet block showing the locking means moved to a position to allow the catch to be released.
Figure 4:
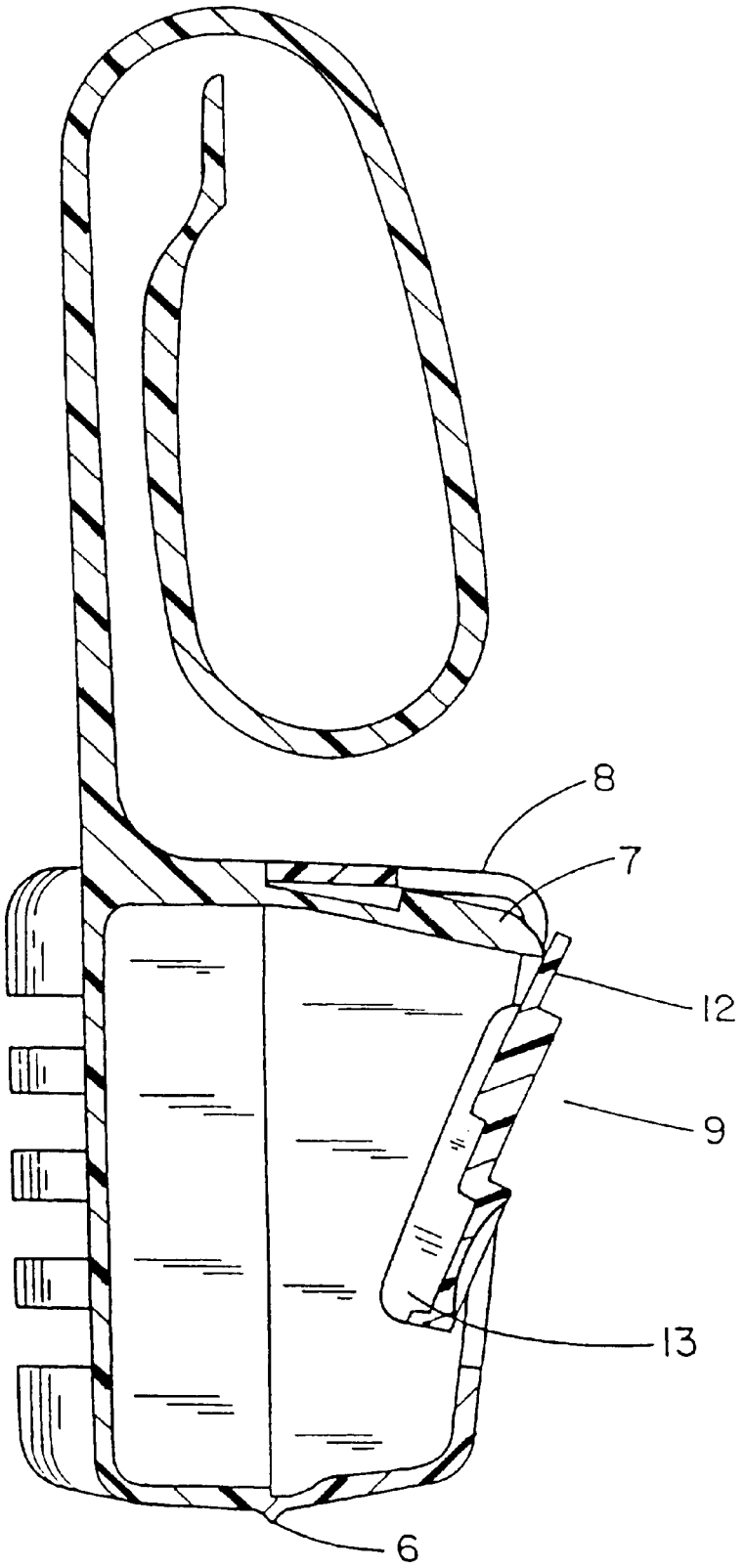
FIG. 4 is a cross section of the dispenser of FIG. 1 without a toilet block showing the catch in the released position.
Figure 5:
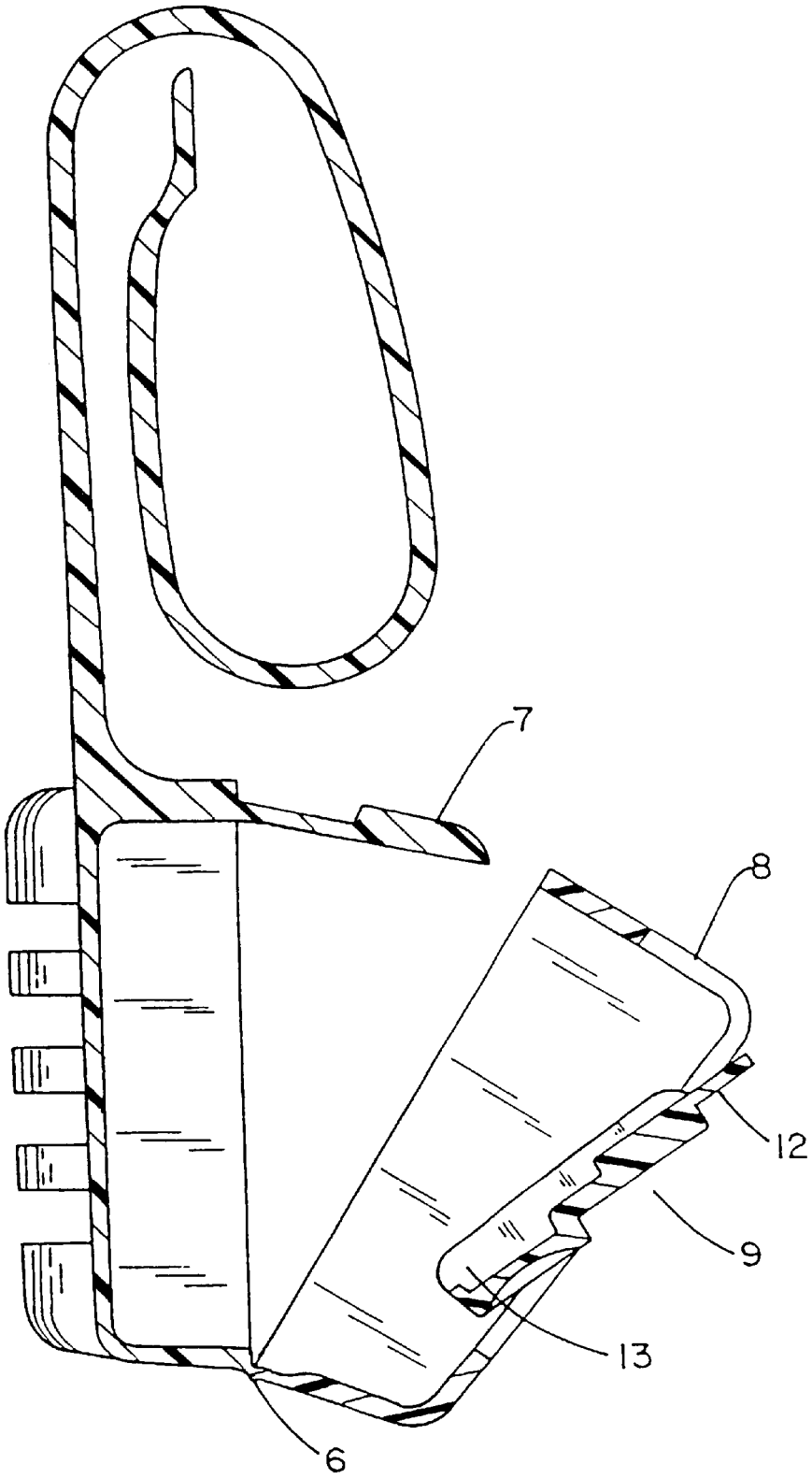
FIG. 5 is a cross section of the dispenser of FIG. 1 in the open position.

As can be seen from FIG. 1, the dispenser comprises a body (1) for receiving a block of material (shown in FIG. 2) and a hook (2) of conventional form attached to its upper end by which the dispenser may be attached to the rim of a toilet bowl. The body (1) is provided with apertures (3) by which water may enter and/or leave the body (1) when the toilet bowl is flushed.

The dispenser is a single moulding made from a suitable thermoplastics material. The moulding comprises a first part which comprises the hook (2) and a first body part (4) which is linked to a second part comprising a second body part (5) by a hinge (6) moulded into the body (see FIGS. 2 to 5).

The two body parts (4) and (5) include at least one releasable catch. The catch may be a direct catch, and may comprise a forwardly projecting lug which carries a projection, such as a barb, and a retaining member, such as an aperture. In the version of the dispenser shown in the Figures, the body part (4) carries a single projecting lug which terminates in a barb (7). When the first and second body parts are brought together by rotation about the hinge (6), the lugs and barbs in body part (4) engage an aperture (8) in body part (5) (this can be best seen in FIGS. 4 and 5). The body parts and projections are sufficiently flexible to allow the barbs to enter the corresponding apertures so as to hold the body (1) closed. The barbs, however, resist separation of the two body parts (4) and (5).

In order to open the body (1), it is necessary to manually depress the barb (7) so that it is released from aperture (8). However, depression of the barb (7) so as to release the catch is normally prevented by a locking means (9). The locking means is connected to body part (5) by pairs of ribs (10,11) on either side of the locking means, but is free at its upper and lower ends. The upper end (12) of locking means (9) when in its normal position engages with the under side of barb (7) to prevent it being depressed. The locking means can be caused to rotate relative to the rest of the body part (5) because the ribs (10,11) are sufficiently flexible to act together as a hinge, but sufficiently resilient to resist permanent deformation and to provide restoring force biasing the locking means back to its normal position in which it prevents depression of the barb. When no toilet block is present in the dispenser, a manual force on the lower end of the locking means causes the lower end (13) to move inwards and the upper end to move outwards relative to the dispenser so that downward movement of the barb (7) is no longer restrained by the locking means (see FIG. 3). While the lower end of the locking means is still pressed inwards, it is then possible to depress the barb (7) (see FIG. 4) and to open the body (see FIG. 5).

If the dispenser contains a new toilet block (14) (see FIG. 2), then it will not be possible to move the lower end of the locking means inward because the lower end of the locking means will engage with the toilet block before the upper end is clear of the barb (7). This is a significant additional safety feature.

When the body is closed by hinging the body parts together the lug will deform so that barb (7) will slide under the body part (5) until it is within the aperture (8) when the force on the lug will be released so that the barb moves into engagement with the aperture (8). If the barb (7) encounters the upper end of the locking means (9), it will be able to slide over the locking means until it is engaged with the aperture (8), so that closure of the body is not impeded. This is desirable both for the consumer replacing a used toilet block, and the manufacturer of the original filled dispenser. However, once the barb has engaged with the aperture, the barb cannot be slid relative to body part (5) and locking means (9) until the locking means has been moved to a position in which it is clear of the barb.

What I claim is:

1. A dispenser suitable for attachment to the rim of a toilet bowl comprises a body adapted to receive a block of product to be dispensed into the toilet bowl and a hook attached to the body for suspending the body from the rim of a toilet bowl, said body comprising first and second body parts relatively rotatable about a hinge and at least one releasable catch which is engaged on rotation of the body parts from an open to a closed position for holding the said body parts in a closed position, said hook being attached to said first body part wherein at least one releasable catch is provided with locking means, which locking means is biased towards a first position in which it acts on the releasable catch to resist release of the catch but is movable by applied manual force to a second position in which the releasable catch can be released wherein the locking means has a block engaging means which engages with a toilet block when the block is present in the dispenser to prevent release of the locking member while the dispenser contains a new toilet block.

2. A dispenser according to claim 1 in which the catch and the locking means must be operated simultaneously to release the catch.

3. A dispenser according to either one of claims 1 or 2 wherein the hinge is on the lower side of the body opposite the hook.

4. A dispenser according to claim 1 wherein the catch is in the form of a lug projecting forwardly from one body part and carries a projection engaging with a retaining member in the other body part.

5. A dispenser according to claim 1 wherein there is only a single releasable catch.

6. A dispenser according to claim 1 wherein the releasable catch is a direct catch.

7. A dispenser according to claim 1 which is a one part moulding.

8. A dispenser according to claim 1 wherein the locking means is moved between the first and second positions by rotation relative to the body part carrying the locking means.

9. A dispenser according to claim 1 wherein the force applied to the locking member acts toward the interior of the body.

10. A dispenser suitable for attachment to the rim of a toilet bowl comprises a body adapted to receive a block of product to be dispensed into the toilet bowl and a hook attached to the body for suspending the body from the rim of a toilet bowl, said body comprising first and second body parts relatively rotatable about a hinge and at least one releasable catch which is engaged on rotation of the body parts from an open to a closed position for holding the said body parts in a closed position, said hook being attached to said first body part wherein at least one releasable catch is provided with locking means, which locking means is biased towards a first position in which it acts on the releasable catch to resist release of the catch but is movable by applied manual force to a second position in which the releasable catch can be released, wherein the locking means is moved by directly applied manual force between the first and second positions by rotation relative to the body part carrying the locking means and wherein the locking means has a block engaging means which engages with a toilet block when the block is present in the dispenser to prevent release of the locking member while the dispenser contains a new toilet block.

11. A dispenser according to claim 10 in which the catch and the locking means must be operated simultaneously to release the catch.

12. A dispenser according to claim 10 wherein the hinge is on the lower side of the body opposite the hook.

13. A dispenser according to claim 10 wherein the catch is in the form of a lug projecting forwardly from one body part and carries a projection engaging with a retaining member in the other body part.

14. A dispenser according to claim 10 wherein there is only a single releasable catch.

15. A dispenser according to claim 10 wherein the releasable catch is a direct catch.

16. A dispenser according to claim 10 which is a one part moulding.

17. A dispenser according to claim 10 wherein the force applied to the locking member acts toward the interior of the body.

18. A dispenser according to claim 10 wherein the locking means has a block engaging means which engages with a toilet block when the block is present in the dispenser to prevent release of the locking member while the dispenser contains a new toilet block.

* * * * *